United States Patent [19]

Sato et al.

[11] Patent Number: 4,617,101

[45] Date of Patent: Oct. 14, 1986

[54] ALKALI METAL CHLORIDE ELECTROLYZING CELL

[75] Inventors: Kimihiko Sato; Yasuo Sajima; Makoto Nakao; Junjiro Iwamoto, all of Yokohama, Japan

[73] Assignee: Asahi Glass Company Ltd., Tokyo, Japan

[21] Appl. No.: 320,436

[22] Filed: Nov. 12, 1981

[30] Foreign Application Priority Data

Nov. 15, 1980 [JP] Japan ..... 55-160116
Nov. 15, 1980 [JP] Japan ..... 55-160117

[51] Int. Cl.[4] ..... C25B 9/00; C25B 11/03; C25B 11/20

[52] U.S. Cl. ..... 204/252; 204/266; 204/283; 204/290 R; 204/286

[58] Field of Search ..... 204/283, 252–258, 204/263–266, 296, 286, 290 R

[56] References Cited

U.S. PATENT DOCUMENTS

| | | | |
|---|---|---|---|
| 3,674,676 | 7/1972 | Fogelman | 204/252 X |
| 3,873,437 | 3/1975 | Pulver | 204/254 |
| 4,124,458 | 11/1978 | Moeglich | 204/283 X |
| 4,135,996 | 1/1979 | Bouy | 204/252 X |
| 4,319,969 | 3/1982 | Oda et al. | 204/296 X |
| 4,341,604 | 7/1982 | De Nora et al. | 204/283 X |
| 4,343,689 | 8/1982 | De Nora et al. | 204/283 X |
| 4,343,690 | 8/1982 | De Nora | 204/283 X |
| 4,381,983 | 5/1983 | Korach | 204/282 X |
| 4,411,749 | 10/1983 | Sato et al. | 204/283 X |
| 4,457,822 | 7/1984 | Asano et al. | 204/283 X |

FOREIGN PATENT DOCUMENTS

| | | | |
|---|---|---|---|
| 2652542 | of 1977 | Fed. Rep. of Germany . | |
| 5316371 | 7/1976 | Japan . | |
| 0063873 | 5/1977 | Japan | 204/296 |
| 52-89589 | 7/1977 | Japan . | |
| 53-11199 | 2/1978 | Japan . | |
| 55-69279 | 5/1980 | Japan . | |
| 1401290 | of 1975 | United Kingdom . | |
| 2007260 | of 1979 | United Kingdom . | |

*Primary Examiner*—Donald R. Valentine
*Attorney, Agent, or Firm*—Oblon, Fisher, Spivak, McClelland & Maier

[57] ABSTRACT

An alkali metal chloride-electrolyzing cell comprises a cation-exchange membrane disposed between an anode and a cathode, characterized in that said cation-exchange membrane has on at least one side thereof a gas- and liquid-permeable, porous layer with no electrode activity, and at least one of an anode and a cathode is a voided flexible electrode having a more rigidity than that of said cation-exchange membrane, and said flexible electrode is designed to be forcibly deformed thereby closely contacting said cation-exchange membrane with the surface of each of said electrodes.

8 Claims, 13 Drawing Figures

ALKALI METAL CHLORIDE ELECTROLYZING CELL

BACKGROUND OF THE INVENTION

1. Field of the Invention

This invention relates to an alkali metal chloride electrolyzing cell and, more particularly, to an alkali metal chloride electrolyzing cell for producing alkali metal hydroxide at a low voltage.

2. Description of the Prior Art

As the process for obtaining alkali metal hydroxide by the electrolysis of an alkali metal chloride aqueous solution, a diaphragm process has recently been taking the place of a mercury process from the point of view of preventing environmental pollution.

With the diaphragm process, there have been proposed several processes of using an ion-exchange membrane as a diaphragm in place of asbestos for obtaining an alkali metal hydroxide with higher purity and higher concentration.

On the other hand, from the viewpoint of energy saving which has recently been attempted on a worldwide scale, it is desired in this technique to minimize the electrolytic voltage.

As the means for reducing the electrolytic voltage, there have so far been proposed various ones such as proper selection of material, composition, and shape of anode or cathode, selection of particular composition of ion-echange membrane to be used or the kind of ion-exchange groups, and the like.

These means have their effects to some extent, but most of them have a limit as to the concentration of the resulting alkali metal hydroxide, i.e., the concentration is at a not so high level, and, when the concentration exceeds the level, there results a rapid increase in electrolytic voltage or a decrease in current efficiency, or else, the phenomenon of electrolytic voltage reduction does not last or durability becomes poor. Thus, all of the conventional processes are not fully satisfactory from the industrial point of view.

It has recently been proposed to electrolyze an alkali metal chloride aqueous solution using an electrolytic cell wherein an anode or a cathode comprising a gas- and liquid-permeable porous layer is closely contacted with the surface of a cation-exchange membrane of a fluorinated polymer, thus obtaining an alkali metal hydroxide and chlorine (see Japanese Unexamined Patent Publication No. 112398/79). This process enables to minimize electric resistance of a solution to be electrolyzed and electric resistance of a hydrogen or chlorine gas to be generated, which has been considered unavoidable in this technique, thus being extremely excellent as a means to conduct electrolysis at a much lower voltage than in the conventional art.

In this process, the anode or cathode is bound to the surface of the ion-exchange membrane so as to imbed the electrode in the membrane, and is made gas- and liquid-permeable to permit the gas generated at the contact interface between the membrane and the electrode by the electrolysis to easily escape from the electrode. Such porous electrodes usually comprise a porous material prepared by uniformly mixing active particles functioning as an anode or cathode, a binder and, preferably a conductive material such as graphite or the like and forming the mixture into a thin film.

However, investigations by the inventors have revealed that, in the case of using an electrolytic cell wherein the above-described electrodes are directly bound to an ion-exchange membrane, the anode, for example, in the electrolytic cell comes into contact with hydroxide ion reversely diffusing from a cathode chamber, and is therefore required to possess alkali resistance as well as conventionally required chlorine resistance, thus a special and expensive material inevitably being selected for the electrode. In addition, though the life of the electrode is usually largely different from that of the ion-exchange membrane, both the electrode and the ion-exchange membrane bound to each other must be discarded when one of them has reached the end of its useful life. Therefore, where an expensive noble metal anode is used, there results a serious economic loss.

As a result of continuing studies on an electrolytic process imposing no such disadvantages and requiring as low a cell voltage as possible, the inventors have formerly discovered that alkali metal hydroxide and chlorine can be obtained, with substantially attaining the above-described object, by applying an unexpectedly low voltage when an alkali metal chloride aqueous solution is electrolyzed in an electrolytic cell wherein an anode or a cathode is disposed via a gas- and liquid-permeable porous layer with no electrode activity formed on the surface of a cation-exchange membrane, and have filed an application relating to this art as Japanese Patent Application No. 152416/79. Further investigations as to the disposition of electrodes have finally lead to the electrolyzing cell of the present invention for producing alkali metal hydroxide.

SUMMARY OF THE INVENTION

In accordance with the present invention, it provides an alkali metal chloride-electrolyzing cell which comprises a cation-exchange membrane disposed between an anode and a cathode, characterized in that said cation-exchange membrane has on at least one side thereof a gas- and liquid-permeable, porous layer with no electrode activity, and at least one of an anode and a cathode is a voided flexible electrode having a more rigidity than that of said cation-exchange membrane, and said flexible electrode is designed to be forcibly deformed thereby closely contacting said cation-exchange membrane with the surface of each of said electrodes.

BRIEF DESCRIPTION OF THE DRAWINGS

FIGS. 1 to 7 show the embodiments wherein only the cathode is flexible.

DETAILED DESCRIPTION OF THE PREFERRED EMBODIMENT

Figure 1:
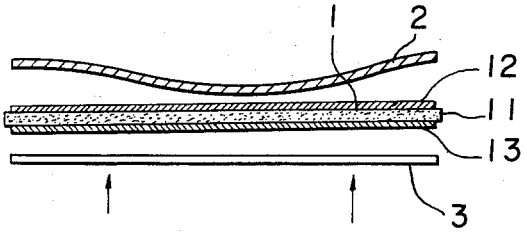
FIG. 1 is a partial sectional view illustrating the relation between the porous layer-bound cation-exchange membrane, anode, and cathode for practicing the present invention.

According to the present invention, electrodes do not directly contact with the membrane because they are disposed via the above-described gas- and liquid-permeable porous layer. Therefore, the anode is not required to possess high alkali resistance, and conventionally widely used electrodes having only chloride resistance can be used as such. In addition, since the electrodes are not necessarily bound to the membrane or the porous layer, the life of the electrodes does not depend upon the life of the membrane.

And, the anode and the cathode are disposed at an almost uniform electrode-to-electrode distance with the porous layer-bound cation-exchange membrane therebetween, resulting in no uneven electric current and in locally constant current density. Since the electrode-to-electrode distance is as short as about the thickness of the above-described cation-exchange membrane, an extreme decrease in electrolytic voltage can naturally be expected.

Further, the cell voltage is unexpectedly low in the process of the present invention. For example, the cell voltage is much lower than that in the process of electrolyzing alkali metal chloride in an electrolytic cell wherein an anode or a cathode is in direct contact with a cation-exchange membrane without intervening of the above-described porous material between them. This must be said to be an unexpectable effect taking it into consideration that the effect can also be obtained where the above-described porous layer if formed by a substantially non-conductive particle layer having no electrode activity unlike the process described in the aforesaid Japanese Patent Publication No. 112398/79.

The electrodes to be used in the present invention are of voided metals such as metal gauze or expanded metal, or of voided metals coated with an ingredient having electrode activity, and are in general as thin as about 0.1 to 3 mm.

As to the size of the electrode, it has a size almost corresponding to the size of an electrode chamber and, in some cases, it is as large as, for example, $1\times2$ m.

Even when the area is smaller than this, it is considerably difficult to face the electrodes having the thickness as thin as described above to each other via the porous layer-bound cation-exchange membrane within a short distance with keeping the electrode-to-electrode distance almost constant at any portion. Because, these electrodes are thin in thickness for the area thereof and are therefore so liable to be deflected that they might be deflected due to change in pressure of an electrolytic solution or that they themselves might be deflected during the production steps thereof.

As a process for solving these problems, the inventors have discovered that such objects can be fully attained by making at least one electrode using a flexible material having more rigidity than that of the porous layer-bound cation-exchange membrane, and deforming said flexible electrode to the side of said cation-exchange membrane.

The present invention will now be described by reference to the attached drawings.

FIG. 1 is a partial sectional view illustrating one embodiment of disposition relation between the cation-exchange membrane having provided thereon a porous layer (porous layer being provided on both sides of the cation-exchange membrane). In FIG. 1, numeral 1 designates a porous layer-bound cation-exchange membrane, 11 designates a cation-exchange membrane, 12 and 13 designate porous layers on the anode side and on the cathode side, respectively, 2 designates an anode comprising, for example, an expanded metal carrying thereon an ingredient having anode activity, which is shown in a somewhat exaggeratedly curved state because it is usually not completely plane, 3 designates a flexible cathode, and arrows indicate the direction of force to be applied to the flexible cathode.

Figure 2:
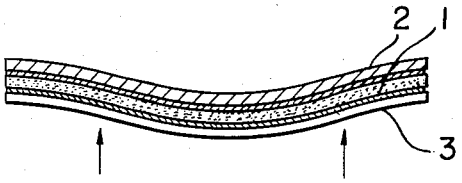
FIG. 2 is a partial sectional view illustrating the result of applying force to the flexible cathode shown in FIG. 1.

FIG. 2 is a partial sectional view showing the result of applying force to the flexible cathode in FIG. 1. In FIG. 2, the porous layer-bound cation-exchange membrane is pushed to the shape of the anode by the force-deformed flexible cathode. In this situation, the flexible cathode has a more rigidity than that of the porous layer-bound cation-exchange membrane, and hence the two are finally deformed to be a shape of the anode. If the rigidity relation is reverse, there can result a partial gap between the anode and the porous layer-bound cation-exchange membrane, thus such relation being unfavorable.

FIGS. 1 and 2 show embodiments wherein the porous layers are provided on both sides of the cation-exchange membrane. However, it is not always necessary to provide the porous layers on both sides of the membrane, and the porous layer may be provided only on one side according to the purpose for providing the porous layer.

And, FIGS. 1 and 2 show embodiments wherein the cathode is flexible, but it is of course possible to use a flexible anode. Flexible electrodes may be used as both anode and cathode, but it is usually better to make only one of the electrodes flexible.

Experience of the inventors has revealed that, where the porous layer is to be provided only on one side, it is preferable to provide it on the anode side of the cation-exchange membrane. The reason for this has not fully been clarified, but it may be attributed to that anodes are generally not fully alkali-resistant and, where they are in direct contact with the cation-exchange membrane, they suffer detrimental influences by hydroxide ion diffusing through the cation-exchange membrane.

The present invention will now be described in more detail by reference to the case wherein the porous layer is provided on both sides of the cation-exchange membrane and only the cathode is flexible. However, it is apparent from the above descriptions that the present invention is not limited only to such embodiment.

Now, as the means for pushing the flexible cathode toward the porous layer-bound cation-exchange membrane, there are considered various means. One of them is to push the flexible cathode by a conductive support. This conductive support is connected to a minus electric power source through other conductive member.

As the preferable conductive support, there are rod- or plate-like conductive rib member, conductive wavy member, and conductive network member.

Figure 3:
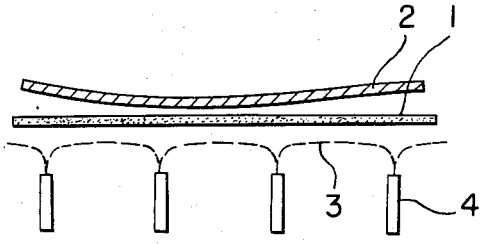
FIG. 3 is a partial sectional view illustrating the disposition relation between the porous layer-bound cation-exchange membrane and the anode and cathode for practicing the present invention using a conductive rib member as a conductive support.
Figure 4:
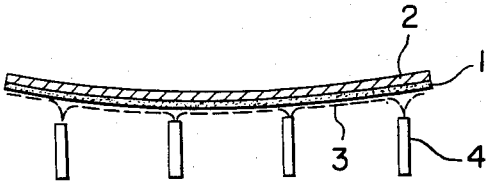
FIG. 4 is a partial sectional view illustrating the state wherein the cathode in FIG. 3 is pushed toward the porous layer-bound cation-exchange membrane by the conductive rib member.

FIGS. 3 and 4 show an embodiment of using a conductive rib member. FIG. 3 is a partial sectional view illustrating the disposition relation between the porous layer-bound cation-exchange membrane, anode and cathode, and a conductive rib member, and FIG. 4 is a partial sectional view illustrating the state wherein the cathode is pushed toward the porous layer-bound cation-exchange membrane by the conductive rib member. In FIGS. 3 and 4, numeral 4 designates a conductive rib member of plates arranged vertically with respect to the paper plane. This conductive rib member 4 is in an electric contact with cathode 3.

Figure 5:
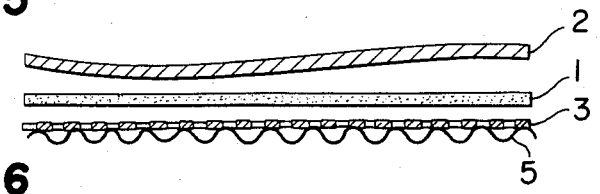
FIG. 5 is a partial sectional view showing the relation between the porous layer-bound cation-exchange membrane, anode, and cathode for practicing the present invention using a conductive wavy member as a conductive support.

FIG. 5 shows an embodiment of using a conductive wavy member as a conductive support, wherein conductive wavy member 5 is disposed in an electric contact with the cathode pushing the cathode toward the porous layer-bound cation-exchange membrane.

Figure 6:
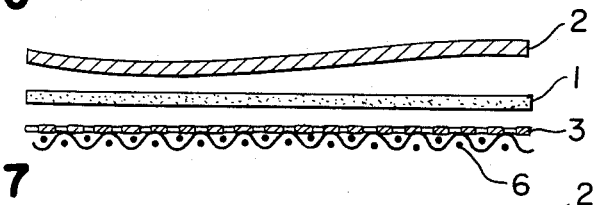
FIG. 6 is a partial sectional view showing the disposition relation between the porous layer-bound cation-exchange membrane, anode, and cathode for practicing the present invention using a conductive network member as a conductive support.

FIG. 6 shows an embodiment of using a conductive network member as a conductive support, wherein conductive network member 6 is disposed in an electric contact with the cathode pushing the cathode toward the porous layer-bound cation-exchange membrane.

Figure 7:
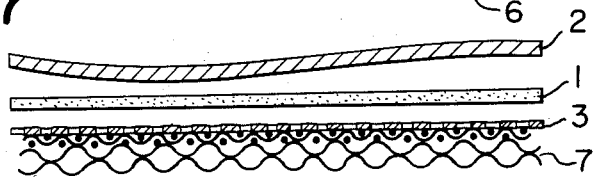
FIG. 7 is a partial sectional view showing the disposition relation between the porous layer-bound cation-exchange membrane, anode, and cathode for practicing the present invention using as a conductive support a composite structure formed by laminating the conductive network member on the conductive wavy member.

FIG. 7 shows an embodiment of using a composite of a conductive network member and a conductive wavy member, wherein conductive composite structure 7 is constituted by laminating conductive network member 71 on conductive wavy members 72 and 73, 71, 72, and 73 are in a full electric contact with each other, and the conductive composite structure 7 pushes the cathode toward the porous layer-bound cation-exchange membrane, with keeping the electric contact with the cathode. Conductive composite structure 7 is not necessarily constituted by one conductive network member and two conductive wavy members, and may be constituted by properly laminating several these members.

Figure 8:
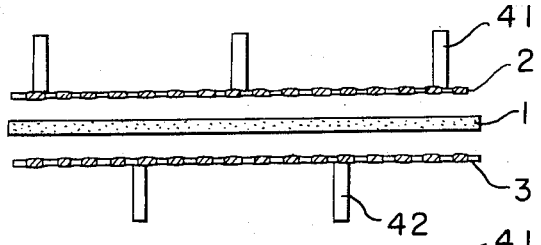
FIG. 8 is a partial sectional view showing the disposition relation between the porous layer-bound cation-exchange membrane, anode, and cathode for praticing the process of the present invention using a flexible anode and a flexible cathode.
Figure 9:
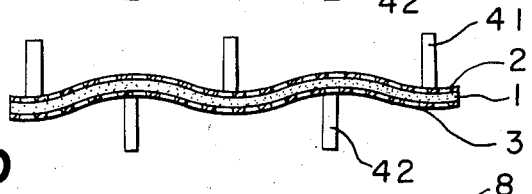
FIG. 9 is a partial sectional view showing the state after deforming the flexible cathode in FIG. 8 by applying a force to the conductive support.

FIGS. 8 and 9 show an embodiment wherein both anode and cathode are flexible. FIG. 8 is a partial sectional view illustrating the disposition relation between the porous layer-bound cation-exchange membrane, flexible anode and flexible cathode, and conductive support. Since both anode 2 and cathode 3 to be disposed sandwitching porous layer-bound cation-exchange membrane 1 are flexible, conductive support 41 on the anode side and conductive support 42 on the cathode side are preferably disposed alternately and not in an opposing arrangement.

FIG. 9 is a partial sectional view illustrating the state wherein a force is applied to conductive support 41 and 42 disposed as in FIG. 8 to deform the flexible electrodes so as to closely contact them with each other.

Figure 10:
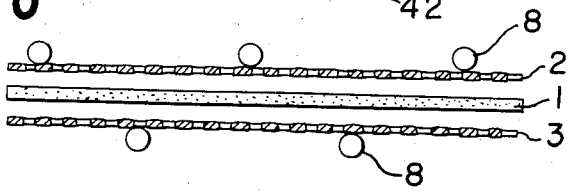
FIG. 10 is a partial sectional view showing the disposition relation between the porous layer-bound cation-exchange membrane, anode, and cathode for practicing the present invention using a flexible anode and a flexible cathode and using conductive rod members as conductive supports.

FIG. 10 shows an embodiment of using conductive rod members as conductive supports, with both anode and cathode being flexible. Conductive rod members 8 disposed in an electric contact with the electrodes are preferably disposed in an alternate arrangement and not in an opposing arrangement.

The inventors discovered that said flexible electrode is preferable to be supported by a conductive, cushioning support to realize the deformation. As a result of further investigations, it has been discovered that spring members such as springs, plate springs, etc. comprising metals corrosion-resistant against an electrolytic solution (for example, valve metals such as titanium for anode side, and alkali-resistance metals such as nickel for cathode side) are suitable as the conductive, cushioning support.

Spring strength of the spring member (spring constant) can properly be selected so as to push the flexible electrode against the porous layer-bound cation-exchange membrane with a uniform strength depending upon the deflectability of the flexible electrode, spring member-disposing distance, and the like.

Figure 11:
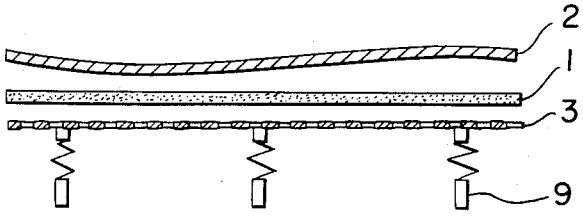
FIG. 11 is a partial sectional view illustrating an embodiment of the disposition relation between an anode, a cathode, a porous layer-bound cation-exchange membrane, and a conductive, cushioning support in an electrolytic cell for practicing the present invention, wherein springs are used as said conductive support.

FIG. 11 is a partial selctional view illustrating one embodiment of disposition relation between the cation-exchange membrane having provided thereon a porous layer (porous layer-bound cation-exchange membrane), anode and cathode, and a conductive cushioning support for practicing the present invention. In FIG. 11 numeral 1 designates a porous layer-bound cation-exchange membrane, 2 designates an anode comprising, for example, an expanded metal carrying thereon an ingredient having anode activity, which is shown in a somewhat exaggeratedly curved state because it is usually not completely plane, 3 designates a flexible cathode, and 9 designates a conductive, cushioning support comprising spring. The porous layer-bound cation-exchange membrane is pushed and deformed along the shape of the anode by the flexible cathode deformed by the force of the conductive, cushioning support.

In this situation, the flexible cathode has a more rigidity than that of the porous layer-bound cation-exchange membrane, and hence the two are finally deformed to the shape of the anode. If the rigidity relation is reverse, there can result a partial gas between the anode and the porous layer-bound cation-exchange membrane, thus such relation being unfavorable.

The above-described porous layer may be provided on both sides of the cation-exchange membrane or only on the anode side or cathode side.

Experience of the inventors has revealed that, where the porous layer is to be provided only on one side, it is preferable to provide it on the anode side of the cation-exchange membrane. The reason for this has not fully been clarified, but it may be attributed to that anodes are generally not fully alkali-resistant and, where they are in direct contact with the cation-exchange membrane, they suffer detrimental influences by hydroxide ion diffusing through the cation-exchange membrane.

The present invention will now be described in more detail by reference to the case where the porous layer is provided on both sides of the cation-exchange membrane and only the cathode is flexible. However, it is apparent from the above descriptions that the present invention is not limited only to such embodiment. The conductive, cushioning support is connected to an electric power source through other conductive member.

Figure 12:
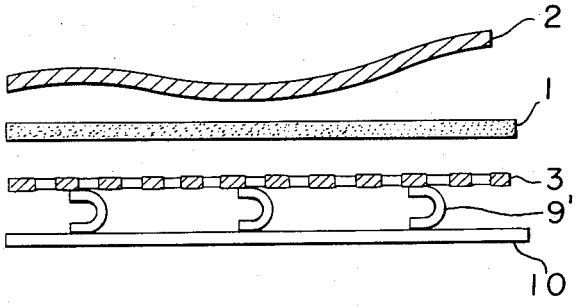
FIG. 12 is a partial sectional view illustrating one embodiment of the disposition relation between an anode, a cathode, a porous layer-bound cation-exchange membrane, and a conductive, cushioning support in an electrolytic cell for practicing the present invention, wherein plate springs are used as said conductive support.

FIG. 12 is a partial sectional view illustrating an embodiment wherein the conductive cushioning support is a plate spring member. In FIG. 12, numeral 9' designates a plate spring member, and 10 designates a conductive member of, for example, a plane form.

Figure 13:
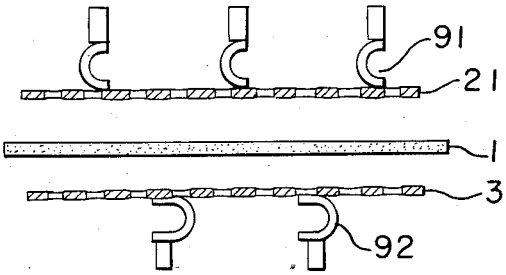
FIG. 13 is a partial sectional view illustrating one embodiment of the disposition relation between an anode, a cathode, a porous layer-bound cation-exchange membrane, and a conductive, cushioning support in an electrolytic cell for practicing the present invention, wherein said both electrodes are flexible and the conductive supports are plate springs on both sides.

FIG. 13 is a partial sectional view illustrating an embodiment wherein plate springs are used as a cushioning member for flexible anode and cathode. In FIG. 13, numeral 21 designates a flexible anode, 91 designates a conductive, cushioning support on the cathode side. In this situation, conductive, cusioning supports on the anode and cathode sides are preferably disposed in an alternate arrangement and not in an opposing arrangement.

As the anode to be used in the present invention, known ones are properly selected such as expanded metals (e.g. titanium, tantalum, etc.) coated with platinum group metals (e.g. ruthenium, iridium, palladium, platinum, etc.), alloys thereof, or with the oxides thereof, porous plates or reticulations of platinum group metals (e.g. platinum, iridium, rhodium, etc.), the alloys thereof, or of the oxides thereof, etc. Of these anodes, expanded metals of titanium, etc. coated with platinum group metals, alloys thereof, or the oxides of the metals or alloys are preferable because they enable to conduct electrolysis at a particularly low voltage.

As the cathode, there are those prepared by coating platinum group metals (e.g. platinum, palladium, rhodium, etc.) or the alloys thereof on a base (e.g. iron), and mild steel, nickel, stainless steel, etc. These are used in the form of porous plate, metal gauze, expanded metal, etc. Of these, cathodes containing platinum group metals, alloys thereof, or nickel as active ingredients are preferable because they can be expected to realize electrolysis ar a particularly low voltage.

On the other hand, the gas- and liquid-permeable, corrosion-resistant porous layer to be used in the present invention is inactive as anode or cathode. That is, the layer is made of a material having a higher chlorine overvoltage or a higher hydrogen overvoltage than that of the electrode to be disposed via said porous layer, such as a non-conductive material. As the materials, there are illustrated, for example, oxides, nitrides, and carbides of titanium, zirconium, niobium, tantalum, vanadium, manganese, molybdenum, tin, antimony, tungsten, bismuth, indium, cobalt, nickel, beryllium, aluminum, chromium, iron, gallium, germanium, selenium, yttrium, silver, lanthanum, cerium, hafnium, lead, thorium, rare earth element, etc. These are used alone or in combination.

Of these, oxides, nitrides and carbides of iron, titanium, zirconium, niobium, tantalum, vanadium, manganese, molybdenum, tin, antimony, tungsten, bismuth, etc. are preferably used alone or in combination as materials for cathode side.

For the anode side, oxides, nitrides, and carbides of iron, hafnium, titanium, zirconium, niobium, tantalum, indium, tin, manganese, cobalt, nickel, etc. are preferably used alone or in combination.

In formation of the porous layer of the present invention using these materials, they are used in the powdery or particulate form preferably bound with a suspension of a fluorine-containing polymer such as polytetrafluoroethylene. If necessary, surfactants may be used for uniformly mixing the two. After being properly formed in a layer form, the mixture is bound to, preferably imbedded in, the surface of the ion-exchange membrane by applying thereto pressure and heat.

The porous layers on the cathode side and the anode side have almost the same physical properties, and suitably possess a mean pore size of 0.01 to 2000$\mu$, porosity of 10 to 99%, and porous layer weight ratio per surface area of 0.01 to 30 mg/cm$^2$ preferably 1 to 15 mg/cm$^2$.

If these physical properties are outside the above-described ranges, there will be a fear of failing to attain desired low electrolytic voltage or a fear that the phenomenon of electrolytic voltage reduction becomes unstable. Thus, physical properties outside the above-described ranges are not preferable. As to the above-described physical properties, a mean pore size of 0.1 to 1000$\mu$ porosity of 20 to 98% are preferable because stable electrolysis at a low voltage can be expected in such case.

The thickness of the porous layer is generally 0.01 to 200$\mu$ preferably 0.1 to 100$\mu$, especially 1 to 50$\mu$ though it is to be strictly decided by the kind and physical properties of material used.

It is preferable that the thickness of a porous layer is less than that of the cation-exchange membrane. This is because otherwise current efficiency becomes lower.

If the thickness is outside the above-described range, there results an increase in electric resistance, a difficulty in gas escape, and a difficulty in transfer of an electrolytic solution through the porous layer.

In the present invention, the anode to be disposed via the above-stated porous layer is provided in contact with the porous layer surface. From the point of reduction in electrolytic cell voltage, it is particularly preferable to provide the porous layer on both sides—anode side and cathode side—of the ion-exchange membrane, though it is also possible to provide the porous layer only on the anode side or on the cathode side.

Where either of the anode and the cathode is provided on the ion-exchange membrane via the porous layer of the present invention, an electrode having the same composition and the same form as that for use in ordinary processes for producing alkali chloride is used as the counter electrode.

An electrode is actually provided on the ion-exchange membrane via the above-described porous layer by, for example, coating a porous layer-forming powder on an ion-exchange membrane according to a screen-printing method or the like, heat-pressing the coating to form a porous layer on the furface of the ion-exchange membrane, and pushing an electrode against the surface of the porous layer.

As the ion-exchange membrane to be used in the present invention, those which comprise a polymer containing cation-exchange groups such as carboxyl group, sulfonic acid group, phosphoric acid group, phenolic hydroxy group, etc. are used. As such polymer, fluorine-containing polymers are particularly preferable. As the fluorine-containing polymers having ion-exchange groups, there are suitably used copolymers between vinyl monomer (e.g. tetrafluoroethylene, chlorotrifluoroethylene, or the like), perfluorovinyl monomer containing a reactive group capable of being converted to an ion-exchange group such as sulfonic acid, carboxylic acid, phosphoric acid, or the like, and perfluorovinyl monomer containing an ion-exchange group such as sulfonic acid, carboxylic acid or phosphoric acid.

In addition, there can be used those which comprise trifluorostyrene membranous polymer having introduced thereinto ion-exchange groups such as sulfonic acid group and those which are prepared by introducing sulfonic acid groups into styrene-divinylbenzene copolymer.

Of these, polymers prepared by using monomers capable of forming the following polymerization units (i) and (ii) are particularly preferable because they enable to obtain caustic alkali with high purity and considerably high current efficiency, $$-(CF_2-CXX')- \quad \text{(i)}$$

$$-(CF_2-\underset{\underset{Y}{|}}{C}-X)- \quad \text{(ii)}$$

where X represents a fluorine atom, a chlorine atom, a hydrogen atom or $-CF_3$, X' represents X or $CF_3(CF_2)_m-$ (wherein m represents 1 to 5), and Y is selected from those of the formulae:

$$-P-A \text{ and } -O-(CF_2)_m-(P, Q, R)-A$$

(wherein P represents $-(CF_2)_a-(CXX')_b-(CF_2)_c$, Q represents $-(CF_2-O-CXX')_d-$, R represents $-(CXX'-O-CF_2)_e-$, (P, Q, R) represents that at least one P, one Q and one R are aligned in an arbitrary order, X and X' are the same as defined above, n=0 to 1, a, b, c, d, and e each represents —COOH or a functional group capable of being converted to —COOH by hydrolysis or neutralization [e.g. —CN, —COF, $-COOR_1$, —COOM, $-CONR_2R_3$, etc. (wherein $R_1$ represents an alkyl group containing 1 to 10 carbon atoms, M represents an alkali metal or a quaternary ammonium group, and $R_2$ and $R_3$ each represents a hydrogen atom or an alkyl group containing 1 to 10 carbon atoms)].

As the preferable examples of Y described above, there are illustrated, for example, the following ones wherein A is bound to a fluorine-containing carbon atom;

$$\text{-}(CF_2)_x\text{-}A,\ -O\text{-}(CF_2)_x\text{-}A,\ \text{-}(O-CF_2-\underset{\underset{Z}{|}}{CF})_y\text{-}A$$

$$\text{-}(O-CF_2-\underset{\underset{Z}{|}}{CF})_x\text{-}(O-CF_2-\underset{\underset{R_f}{|}}{CF})_y\text{-}A$$

-continued $$-O-CF_2\text{-}(\underset{\underset{Z}{|}}{CF}-O-CF_2)_x\text{-}(CF_2-O-CF)_z\text{-}A$$

wherein x, y, and e each represents 1 to 10, Z and $R_f$ each represents —F or a perfluoroalkyl group containing 1 to 10 carbon atoms, and A is the same as defined above.

Where a fluorine-containing cation-exchange membrane comprisng such copolymer and having an intramembranous carboxylic acid group density of 0.5 to 2.0 meq per g of the dry resin is used, a current efficiency as high as 90% or more can be attained even when concentration of caustic soda becomes 40% or more. Intramembranous carboxylic acid density of 1.12 to 1.7 meq per g of the dry resin is particularly preferable because such density assures to obtain caustic soda with as high a concentration as described above and with high current efficiency over a long period of time. For attaining the above-described ion-exchange capacity, the copolymers comprising the above-described polymerization units (i) and (ii) preferably contains 1 to 40 mol %, particularly preferably 3 to 25 mol %, of (ii).

Preferable ion-exchange membrane to be used in the present invention are constituted by a non-crosslinkable copolymer obtained by the copolymerization between a fluorine-containing olefin monomer as described above and a polymerizable monomer having a carboxylic acid group or a functional group capable of being converted to carboxylic acid group. The molecular weight of the copolymer ranges preferably from about 100,000 to 2,000,000, particularly preferably from 150,000 to 1,000,000. In preparing such copolymer, one or more monomers per each monomer unit are used, a third monomer optionally being copolymerized to modify the membrane. For example, the combined use of $CF_2=CFOR_f$ (wherein $R_f$ represents a perfluoroalkyl group containing 1 to 10 carbon atoms) can impart flexibility to a resulting membrane, and the combined use of divinyl monomer such as $CF_2CF=CF=CF_2$ or $CF_2=CFO(CF_2)_{1-3}CF=CF_2$ can crosslink the copolymer to thereby impart mechanical strength to the membrane.

Copolymerization between the fluorinated olefin monomer, the polymerizable monomer having a carboxylic acid group or a functional group capable of being converted to carboxylic acid group and, if necessary, the third monomer can be conducted in any conventionally known process. That is, the copolymerization can be conducted by catalytic polymerization, thermal polymerization, radiation polymerization, etc. using, if necessary, a solvent such as halogenated hydrocarbon. Processes to be employed for filming the thus obtained copolymer into an ion-exchange membrane are not particularly limited, and known ones such as press-molding, roll-molding, extrusion molding, solution casting, dispersion molding, powder molding, etc. may properly be employed.

Thickness of the thus obtained membrane is suitably controlled to 20 to 500μ, particularly preferably 50 to 400μ.

Where the copolymer contains functional groups capable of being converted to carboxylic acid group and does not contain carboxylic acid groups, the functional groups are converted to carboxylic acid groups by a proper corresponding treatment before or after, preferably after, the filming step. For example, where the functional groups are —CN, —COF, —$COOR_1$, —COOM, or —$CONR_2R_3$ (wherein M and $R_1$–$R_3$ are the same as defined hereinbefore), they are converted to carboxylic acid groups by hydrolysis or neutralization using an acid or alkali alcohol solution, and, when the functional groups are double bonds, they are reacted with —$COF_2$ to convert to carboxylic acid groups.

Further, the cation-exchange membrane to be used in the present invention may, if necessary, be mixed with an olefin polymer such as polyethylene or polypropylene, preferably fluorine-containing polymer such as polytetrafluoroethylene or ethylene-tetrafluoroethylene copolymer before being molded. It is also possible to reinforce the membrane by using texture (e.g. cloth, net, etc.), non-woven fabric, porous film, or the like comprising these copolymers, or metalic wire, net, or porous body as a support.

As the alkali metal chloride to be subjected to the electrolysis, sodium chloride is generally used. In addition, the alkali metal chloride further includes alkali metal chlorides such as potassium chloride, lithium chloride, etc.

The present invention will now be described in more detail by reference to examples.

EXAMPLE 1

73 mg of tin oxide powder having a particle size of not larger than 44μ was suspended in 50 cc of water, and a polytetrafluoroethylene (PTFE) suspension (made by E. I. du Pont de Nemours & Co. Inc.; trade name: Teflon 30 J) was added thereto in a PTFE amount of 7.3 mg. After adding thereto a drop of a nonionic surfactant (Triton X-100; made by Rohm & Haas Co.), the mixture was stirred by means of an ultrasonic wave stirrer under ice-cooling, then suction-filtered onto a porous PTFE membrane to obtain a porous tin oxide thin layer.

This thin layer had a thickness of 30μ and a porosity of 75%, and contained 5 mg/$cm^2$ tin oxide.

On the other hand, a thin layer having a thickness of not more than 44μ and a porosity of 73% was formed in the same manner. Then, the two thin layers were laminated on respective sides of a 250-μ thick ion-exchange membrane comprising a copolymer between tetrafluoroethylene and $CF_2{=}CFO(CF_2)_3COOCH_3$ and having an ion-exchange capacity of 1.45 meq/g resin so that the porous PTFE membrane was on the opposite side of the ion-exchange membrane, and pressure was applied thereto under the conditions of 160° C. in temperature and 60 kg/$cm^2$ in pressure to thereby bind the porous thin layers to the ion-exchange membrane. Subsequently, the porous PTFE membrane was removed to obtain an ion-exchange membrane having porous layers of tin oxide and nickel oxide closely bound to the respective sides.

This ion-exchange membrane was dipped in a 90° C., 25 wt % sodium hydroxide aqueous solution for 16 hours to hydrolyze the ion-exchange membrane.

Then, there was prepared an anode comprising an expanded titanium metal of 6×13 mm in opening size and 1.5 mm in plate thickness having coated thereon ruthenium oxide. As a cathode, an expanded nickel metal of 3×6 mm in opening size and 0.5 mm in plate thickness was used. These were disposed as in FIGS. 3 and 4 by the following procedures. As a conductive support, 4-mm thick nickel plates were disposed at 10.3 mm intervals, the tops of the plates were welded to the above-described expanded nickel metal, and the nickel electrode was slightly loosened to narrow the intervals of the support to 10 mm as shown in FIG. 2. Then, the conductive support is pushed toward anode side as shown in FIG. 3. Subsequently, known cell frame of hollow pipes or the like was used to assemble an electrolytic cell.

Electrolysis was conducted at 90° C. by keeping the concentration of a sodium chloride aqueous solution in the anode chamber of the electrolytic cell at 4N and feeding water to the cathode chamber to maintain the concentration of sodium hydroxide in the cathode solution at 35 wt %. Thus, there were obtained the following results.

| Current Density (A/$dm^2$) | Cell Voltage (V) |
|---|---|
| 10 | 2.70 |
| 20 | 2.90 |
| 30 | 3.11 |
| 40 | 3.28 |

EXAMPLE 2

An electrolytic cell was constructed in the same manner as in Example 1 except for using a 0.5-mm thick nickel wavy plate of 15 mm in amplitude and 70 mm in pitch as the conductive support and welding the crest portions of this plate to an expanded nickel metal cathode, and electrolysis was conducted in the same manner as in Example 1 to obtain the results as follows.

| Current Density (A/$dm^2$) | Cell Voltage (V) |
|---|---|
| 10 | 2.73 |
| 20 | 2.94 |
| 30 | 3.15 |
| 40 | 3.31 |

EXAMPLE 3

Electrolysis was conducted in the same manner as in Example 1 except for welding a cathode of expanded nickel metal to a conductive support of 20-mesh nickel network member at one position per 2 $cm^2$. Results thus obtained are given below.

| Current Density (A/$dm^2$) | Cell Voltage (V) |
|---|---|
| 10 | 2.68 |
| 20 | 2.89 |
| 30 | 3.09 |
| 40 | 3.26 |

EXAMPLE 4

The same nickel wavy plate as used in Example 2 and the same nickel network member as used in Example 3 were laminated and welded in the order of nickel wavy plate/nickel wavy plate/nickel network member to obtain a conductive composite structure. Then, the nickel network side of this composite conductive layer was welded to a cathode of expanded nickel metal at one position per 2 $cm^2$. Other procedures were the same as in Example 1 to assemble an electrolytic cell, and electrolysis was conducted in the same manner as in Example 1. Results thus obtained are given below.

| Current Density (A/dm$^2$) | Cell Voltage (V) |
|---|---|
| 10 | 2.69 |
| 20 | 2.90 |
| 30 | 3.12 |
| 40 | 3.27 |

EXAMPLE 5

As an anode, an expanded titanium metal of 3×6 mm in opening size coated with ruthenium oxide was used and, as a cathode, an expanded nickel metal of 3×6 mm in opening size was used. 4-mm thick titanium plates were welded as a support to the anode at 10-cm intervals, and 4-mm thick nickel plates to the cathode at 10-cm intervals. These were disposed so that the conductive supports were in an alternate arrangement with sandwitching the porous layer-bound cation-exchange membrane prepared in the same manner as in Example 1 between the two electrodes, thus the two electrodes being pushed toward the cation-exchange membrane. Other procedures were conducted in the same manner as in Example 1 to assemble an electrolytic cell, and electrolysis was conducted in the same manner as in Example 1. Results thus obtained are as follows.

| Current Density (A/dm$^2$) | Cell Voltage (V) |
|---|---|
| 10 | 2.68 |
| 20 | 2.88 |
| 30 | 3.08 |
| 40 | 3.28 |

EXAMPLE 6

73 mg of tin oxide powder having a particle size of not larger than 44$\mu$ was suspended in 50 cc of water, and a polytetrafluoroethylene (PTFE) suspension (made by E. I. du Pont de Nemours & Co. Inc.; trade name: Teflon 30 J) was added thereto in a PTFE amount of 7.3 mg. After adding thereto a drop of a nonionic surfactant (Triton X-100; made by Rohm & Haas Co.), the mixture was stirred by means of an ultrasonic wave stirrer under ice-cooling, then suction-filtered on a porous PTFE membrane to obtain a porous tin oxide thin layer.

This thin layer had a thickness of 30$\mu$ and a porosity of 75%, and contained 5 mg/cm$^2$ tin oxide.

On the other hand, a thin layer having a thickness of not more than 44$\mu$ and a porosity of 73% was formed in the same manner. Then, the two thin layers were laminated on respective sides of a 250-$\mu$ thick ion-exchange membrane comprising a copolymer between tetrafluoroethylene and $CF_2{=}CFO(CF_2)_3COOCH_3$ and having an ion-exchange capacity of 1.45 meq/g resin, so that the porous PTFE membrane was on the opposite side of the ion-exchange membrane, and pressure was applied thereto under the conditions of 160° C. in temperature and 60 kg/cm$^2$ in pressure to thereby bind the porous thin layer to the ion-exchange membrane. Subsequently, the porous PTFE membrane was removed to obtain an ion-exchange membrane having porous layers of tin oxide and nickel oxide closely bound to the respective sides.

This ion-exchange membrane was dipped in a 90° C., 25 wt % sodium hydroxide aqueous solution for 16 hours to hydrolyze the ion-exchange membrane.

Then, there was prepared an anode comprising an expanded metal of titanium of 6×13 mm in opening size and 1.5 mm in plate thickness having coating thereon ruthenium oxide. As a cathode, an expanded nickel metal of 3×6 mm in opening size and 0.5 mm in plate thickness was used, to which nickel-made plate springs of 0.3 mm in plate thickness and 7 mm in radium of curvature were fastened at intervals of 7 mm by welding. An electrolytic cell was constructed by fitting the anode and the cathode to a known cell frame of hollow pipes or the like so that the electrodes and the porous layer-bound cation-exchange membrane were disposed as shown in FIG. 12 to push the cathode toward the anode.

Electrolysis was conducted at 90° C. by keeping the concentration of a sodium chloride aqueous solution in the anode chamber of the electrolytic cell at 4N and feeding water to the cathode chamber to maintain the concentration of sodium hydroxide in the cathode solution at 35 wt %. Thus, there were obtained the following results.

| Current Density (A/dm$^2$) | Cell Voltage (V) |
|---|---|
| 10 | 2.70 |
| 20 | 2.90 |
| 30 | 3.11 |
| 40 | 3.28 |

EXAMPLE 7

Titanium-made plate springs of 0.5 mm in plate thickness and 7 mm in radius of curvature were weld-fastened at intervals of 7 mm to anode comprising an expanded titanium metal of 3×6 mm in opening size having coated thereon ruthenium oxide. This anode and the cathode in Example 1 were disposed so that centers of the plate springs of the electrods were in an alternate arrangement. These electrodes and the porous layer-bound cation-exchange membrane prepared in the same manner as in Example 6 were disposed as shown in FIG. 13. Subsequent procedures were conducted in the same manner as in Example 6 to assemble an electrolytic cell. Electrolysis was conducted in the same manner as in Example 6 to obtain the results as follows.

| Current Density (A/dm$^2$) | Cell Voltage (V) |
|---|---|
| 10 | 2.68 |
| 20 | 2.88 |
| 30 | 3.09 |
| 40 | 3.27 |

We claim:

1. An alkali metal chloride-electrolyzing cell which comprises a cation-exchange membrane disposed between an anode and a cathode, characterized in that said cathode-exchange membrane has on at least one side thereof a gas- and liquid-permeable, porous layer which is non-conductive, and at least one of an anode and a cathode is a voided flexible electrode having more rigidity than that of said cation-exchange membrane and in electrical contact with a conductive support member, and said flexible electrode is designed to be forcibly deformed thereby closely contacting said cation-exchange membrane with the surface of each of said electrodes.

2. An alkali metal chloride electrolyzing cell as described in claim 1, wherein said conductive support is a conductive wavy member.

3. An alkali metal chloride electrolyzing cell as described in claim 1, wherein said conductive support is a conductive network member.

4. An alkali metal chloride electrolyzing cell as described in claim 1, wherein said conductive support is a conductive, composite structure comprising a conductive wavy member and a conductive network member laminated one over the other.

5. An alkali metal chloride electrolyzing cell as described in claim 1, wherein said anode and said cathode are flexible, and conductive supports supporting the anode and the cathode are disposed alternatively and not in an opposing arrangement.

6. An alkali metal chloride electrolyzing cell as described in claim 1, wherein said conductive support is a conductive cushioning support.

7. An alkali metal chloride electrolyzing cell as described in claim 8, wherein said conductive, cushioning support comprises a spring member such as spring, plate spring, or the like.

8. An alkali metal chloride electrolyzing cell as described in claim 1, wherein the thickness of the gas- and liquid-permeable porous layer is less than that of the cation-exchange membrane.

* * * * *